US008307503B1

(12) United States Patent
Burger

(10) Patent No.: US 8,307,503 B1
(45) Date of Patent: Nov. 13, 2012

(54) SLOW CLOSING HINGE APPARATUS

(76) Inventor: George Burger, Rocklin, CA (US)

( * ) Notice: Subject to any disclaimer, the term of this patent is extended or adjusted under 35 U.S.C. 154(b) by 516 days.

(21) Appl. No.: 12/572,798

(22) Filed: Oct. 2, 2009

(51) Int. Cl.
*E05F 1/08* (2006.01)

(52) U.S. Cl. ..... 16/277; 16/297; 16/278; 16/50

(58) Field of Classification Search ..... 16/277, 16/297, 298, 278, 295, 307, 308, 50
See application file for complete search history.

(56) References Cited

U.S. PATENT DOCUMENTS

| | | | | |
|---|---|---|---|---|
| 1,556,204 | A * | 10/1925 | Cohen | 16/50 |
| 2,203,197 | A * | 6/1940 | Henry | 16/50 |
| 2,814,049 | A * | 11/1957 | Mercur | 4/241 |
| 3,903,567 | A * | 9/1975 | Suska | 16/301 |
| 5,109,571 | A * | 5/1992 | Ohshima et al. | 16/307 |
| 5,572,768 | A * | 11/1996 | Daul | 16/49 |
| 5,651,536 | A * | 7/1997 | Daul | 16/50 |
| 5,996,132 | A * | 12/1999 | Sorimachi | 16/303 |
| 6,085,384 | A * | 7/2000 | Bivens | 16/54 |
| 6,336,252 | B1 * | 1/2002 | Bando | 16/307 |
| 6,817,061 | B2 * | 11/2004 | Wu et al. | 16/308 |
| 7,111,363 | B2 * | 9/2006 | Lee et al. | 16/376 |
| 7,155,776 | B2 * | 1/2007 | Park | 16/50 |
| 7,401,381 | B2 * | 7/2008 | Konja et al. | 16/285 |
| 7,530,143 | B2 * | 5/2009 | Qin et al. | 16/285 |
| 8,104,142 | B2 * | 1/2012 | Lowry et al. | 16/307 |
| 2003/0051313 | A1 * | 3/2003 | Wu | 16/298 |
| 2003/0177605 | A1 * | 9/2003 | Wang | 16/50 |
| 2004/0250377 | A1 * | 12/2004 | Park | 16/50 |
| 2006/0032021 | A1 * | 2/2006 | Fukuo | 16/298 |
| 2008/0092335 | A1 * | 4/2008 | Hu et al. | 16/308 |
| 2009/0025181 | A1 * | 1/2009 | Burger | 16/286 |
| 2009/0133219 | A1 * | 5/2009 | Lowry et al. | 16/304 |

FOREIGN PATENT DOCUMENTS

| | | |
|---|---|---|
| KR | 1020030090233 A | 11/2003 |
| KR | 200421868 | 7/2006 |
| WO | 9954583 | 10/1999 |

* cited by examiner

*Primary Examiner* — Jeffrey O Brien
(74) *Attorney, Agent, or Firm* — Alexander P. Brackett; Middleton Reutlinger

(57) ABSTRACT

A self-closing hinge comprises a stationary assembly comprising a hollow cylindrical tube having a first end and a second end having a clutch stationary assembly secured thereto. The hinge further includes a first torsional spring positioned within said tube and secured at the first end thereof, and has a pin secured at a second end of said first torsional spring whereby said spring biases said pin in a first direction and whereby said pin rotates to engage said clutch assembly at a at least one point. A rotating intermediate tube assembly comprises a generally hollow cylinder having a first end positioned over said stationary assembly, and a second end having a clutch rotating assembly, whereby said pin of said torsional spring engages said clutch rotating assembly at a point. The invention further comprise an exterior tube assembly comprising a generally hollow cylinder having a first open end positioned over said intermediate tube assembly and a second closed end, and a second torsional spring positioned between and secured to said intermediate tube assembly and said exterior tube assembly.

5 Claims, 9 Drawing Sheets

SLOW CLOSING HINGE APPARATUS

BACKGROUND OF THE INVENTION

1. Field of the Invention

The present invention relates generally to a hinge mechanism and more specifically to an improved self-closing hinge system capable of controlling a rate of rotation of said hinge and further capable of being mounted to any device requiring closing such as a door or toilet seat wherein the hinge system slowly returns the device to a closed position.

2. Description of the Related Art

Often, it is desirable to provide a hinge mechanism which maintains a device, or a rotating member, in a predetermined open or closed position and further, when opened or closed, returns the rotating member to its predetermined position at a relatively slow and constant rate. Slow or self-closing hinges are particularly desirable in the case of such rotating members as toilet seats, cabinet doors, exterior doors, and flip-open type cellular telephones where a dampened return to a predetermined position is helpful to the user.

In some prior art self-closing hinge devices, a spring bias member is secured between the hinged member and the device whereby the hinged member is opened against the force of the spring member. When the hinged member is released the force provided by the spring rotates the hinged member to its closed position. This simple type of self-closing hinge device is unsatisfactory in many cases because the rotating member is forced back too quickly, thus slamming it to its closed position and potentially causing damage to the rotational member, or an operator. Where devices of this type are installed on, for example, toilet seats, the seat is slammed down against the toilet base, thereby causing a great deal of noise which is highly undesirable in most applications. Additionally, in systems such as these the seat is being forced downwardly (closed) by the spring tension at all times, thereby requiring it to be held in its up or open position.

To overcome these difficulties, some prior art hinge mechanisms have employed dampening systems to inhibit the quick closing tendencies of spring-biased self-closing hinges. Some prior art dampening hinge mechanisms comprise complex combinations of axial elements, cams, viscoelastic fluids, bearings and the like to provide hinges wherein the opening and or closing speed of the hinge mechanism can be regulated.

Many prior art dampening mechanisms that utilize dampening systems unnecessarily limit or regulate the opening speed of the hinge, which is highly undesirable when said hinge is utilized in conjunction with a door or cabinet door. In such environments it is preferable to be able to open the door at an unregulated speed wherein the hinge "keeps up" with the rotational motion of the door and then slowly closes the door.

Accordingly, there is a need in the art for a self-closing hinge apparatus that is simple and economical to manufacture and produce and that does not limit its rate of rotation in a first direction, while maintaining the ability to regulate its rate of rotation in a second direction.

SUMMARY OF THE INVENTION

The present invention provides a self-closing hinge suitable for use in a variety of applications where it is desirable to provide for automatic closing of a hinged member in a delayed or slow fashion. The invention described and claimed herein may be advantageously employed in toilet seats or lids, ingress and egress doors, cabinet doors or even flip-top style cellular phones.

The invention includes a generally cylindrical exterior assembly or housing that is secured to the rotating member and that encloses a rotatable intermediate tube assembly that is connected by a torsional spring to the exterior assembly. Further, a viscous fluid is disposed between intermediate and exterior assemblies to prevent rapid relative motion between them.

An inner tube assembly which does not rotate is also secured to the intermediate tube assembly by a second torsional spring. A novel clutch assembly is also provided. The clutch assembly comprises a non-rotating stationary portion and a rotating portion, each of which contain pin recesses for passing off or transferring a torsion pin between them. The torsion pin is forced to rotate with the rotating clutch portion when it is engaged by its pin recess, and it is prevented from rotation when engaged by the stationary clutch portion pin recess.

In this fashion, the intermediate tube assembly rotates relative to the outer tube and inner tube assemblies, while the torsional pin is passed from the stationary clutch portion to the rotating portion thereby setting and resetting the self-closing hinge described herein. As the opened rotating member is forced back to a closed position by operation of a torsional spring, the hinge resets itself by passing the torsional pin back to the stationary clutch portion, thereby providing a relatively slow return to a closed position.

Other features and advantages of the present invention will become apparent from the detailed description of the preferred embodiments herein below in conjunction with the drawing Figures appended hereto.

BRIEF DESCRIPTION OF THE DRAWING FIGURES

DETAILED DESCRIPTION OF THE PREFERRED EMBODIMENT(S)

Figure 1:
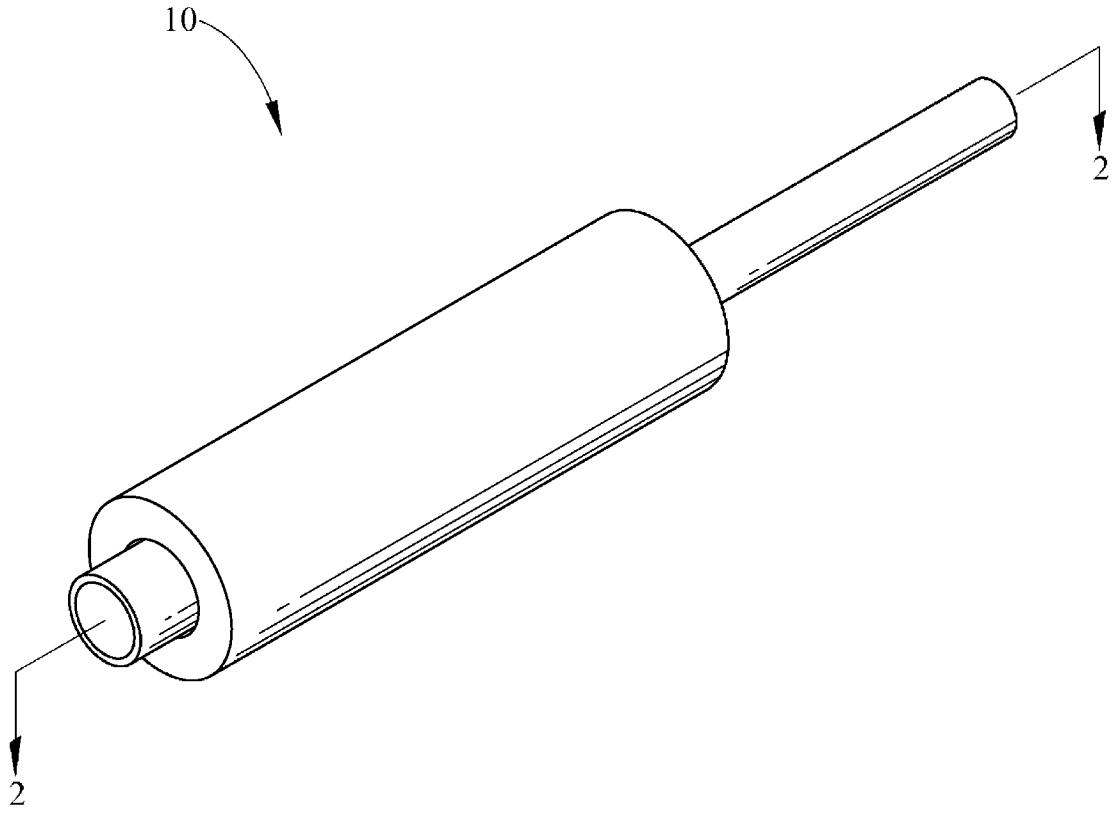
FIG. 1 is a perspective view of a slow-closing hinge in accordance with one embodiment of the present invention.
Figure 2:
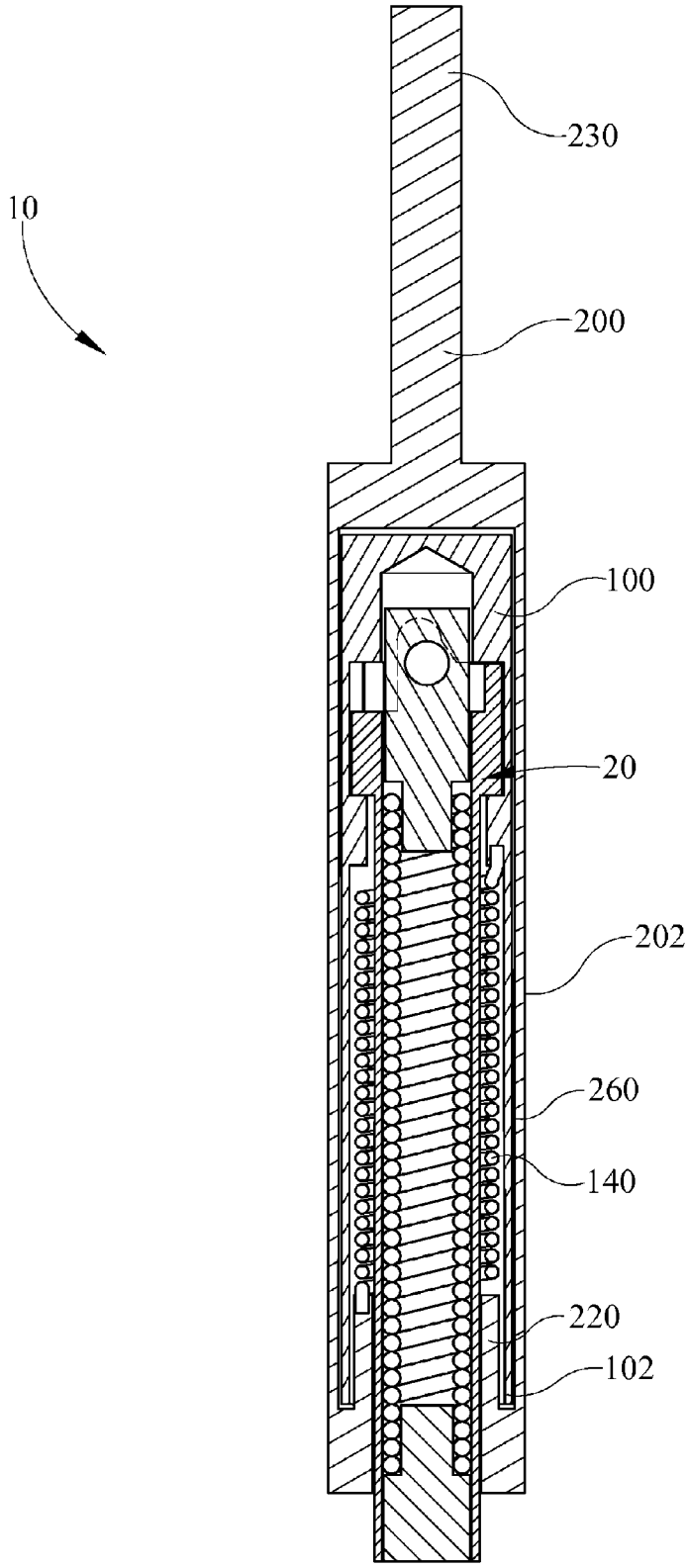
FIG. 2 is a cross-sectional view of the slow-closing hinge taken along the line 2-2 of FIG. 1 in accordance with one embodiment of the present invention.
Figure 3:
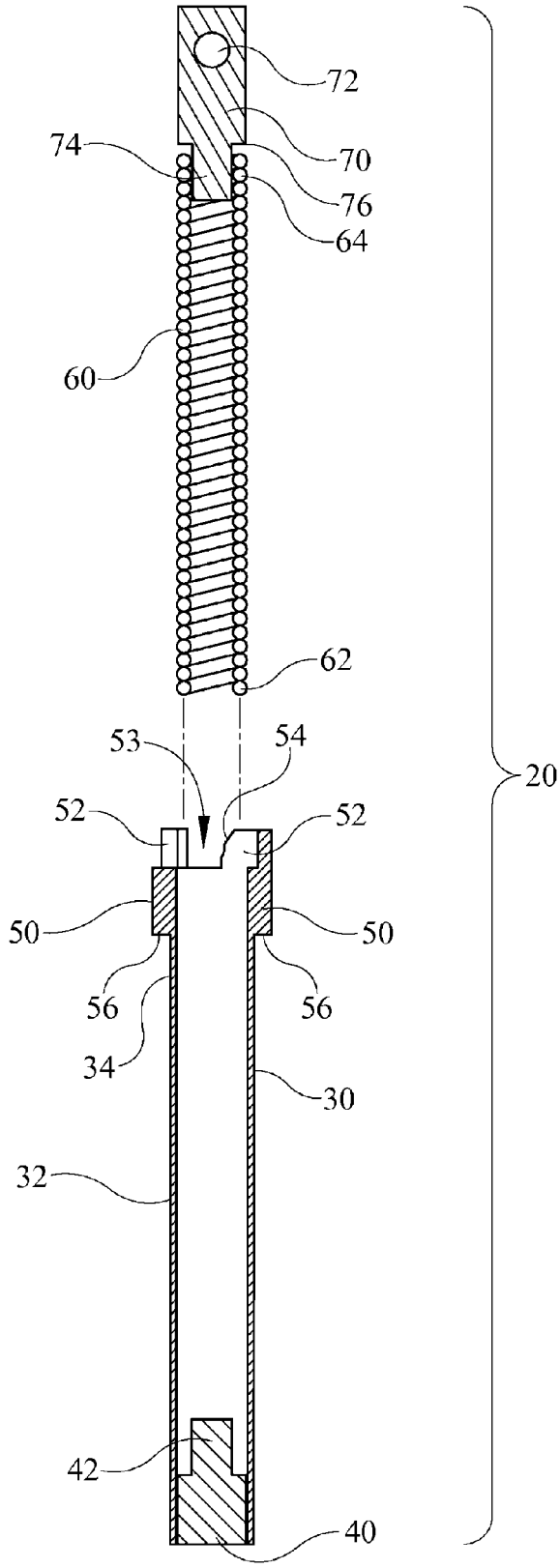
FIG. 3 is an exploded cross-sectional view of the inner tube and pin assemblies in accordance with one embodiment of the present invention.

Referring now to FIGS. 1-3 and in accordance with a preferred constructed embodiment of the present invention, a self-closing hinge 10 comprises a stationary assembly 20, a generally concentric rotating intermediate tube assembly 100 and a generally concentric exterior tube assembly 200 which may be secured to a hinged member such as a door, cell-phone screen, or toilet seat (not shown). Referring specifically to FIG. 3, stationary assembly 20 comprises an inner tube 30, generally tubular in shape, having a closed bottom 40 and a spring engagement member 42 extending therefrom onto the interior of inner tube 30.

Inner tube 30 includes a cylindrical wall 32 connecting bottom 40 with a generally cylindrical clutch stationary portion 50 that is disposed at a top end 34 of tube 30. Clutch stationary portion 50 includes a pair of spaced pin stops 52 that extend upwardly in the longitudinal direction with respect to tube 30. Pin stops 52 are separated along the circumference of clutch stationary portion 50 by a pin space 53, which provides clearance for the rotational motion of a clutch torsional pin, as will be discussed further below. Additionally, adjacent one of said pin stops 52 is disposed a ramped portion 54 which provides a sloped transition from pin space 53 to the top of pin stop 52.

Figure 4:
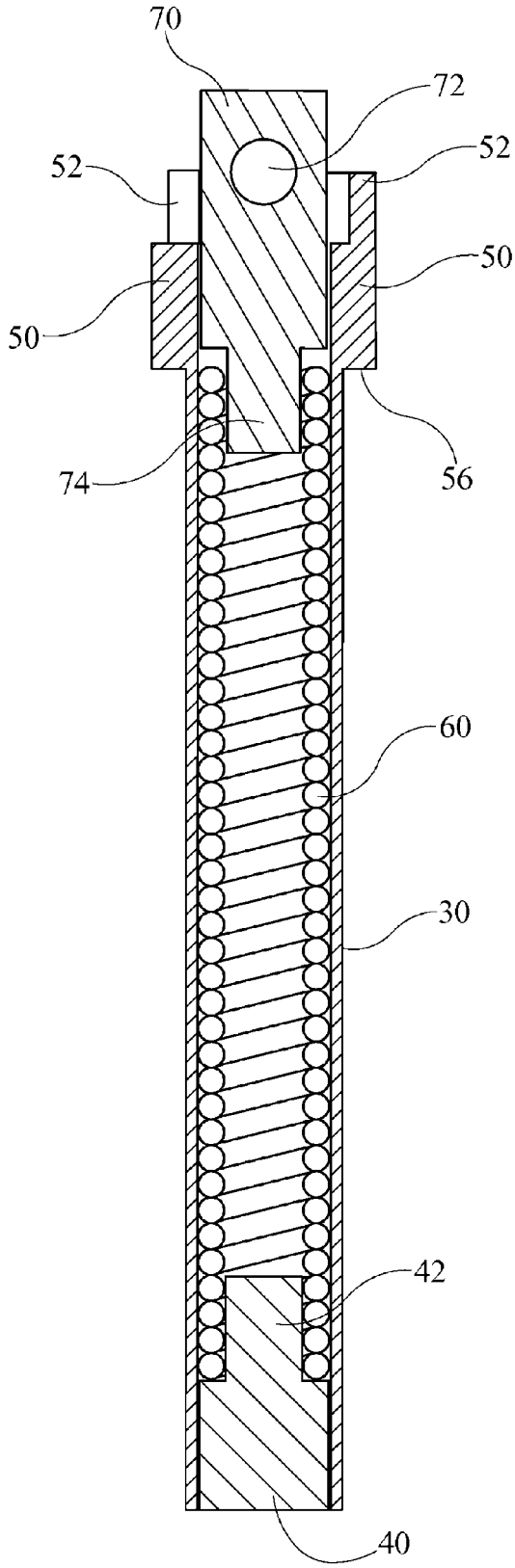
FIG. 4 is an assembled cross-sectional view of the stationary and pin assemblies in accordance with one embodiment of the present invention.

Clutch stationary portion 50 may further include a lower edge 56 that extends radially outwardly from tube 30. As best seen in FIGS. 3 and 4 stationary assembly 20 inner tube 30 is adapted to receive a first torsional spring 60 in the interior thereof. Lower end 62 of spring 60 is secured to spring engagement member 42 so that spring 60 is oriented generally concentric with tube 30. A pin assembly 70, which is generally cylindrical in shape, includes a flange 74 extending therefrom which is secured to an upper end 64 of first torsional spring 60. Accordingly, spring 60 provides a rotational bias between pin assembly 70 and inner tube 30.

Additionally, a torsional pin 72 is disposed through assembly 70, having its axis at a right angle to the axis of pin assembly 70, thereby extending outwardly from either side of pin assembly 70. FIG. 8 provides a top view of pin assembly 70 and torsional pin 72, the arrows indicating that assembly 70 and thus pin 72 are capable of rotation as torsional spring 60 twists. FIG. 4 depicts torsional spring 60 secured to engagement member 42 and nesting inside inner tube 30.

Figure 5:
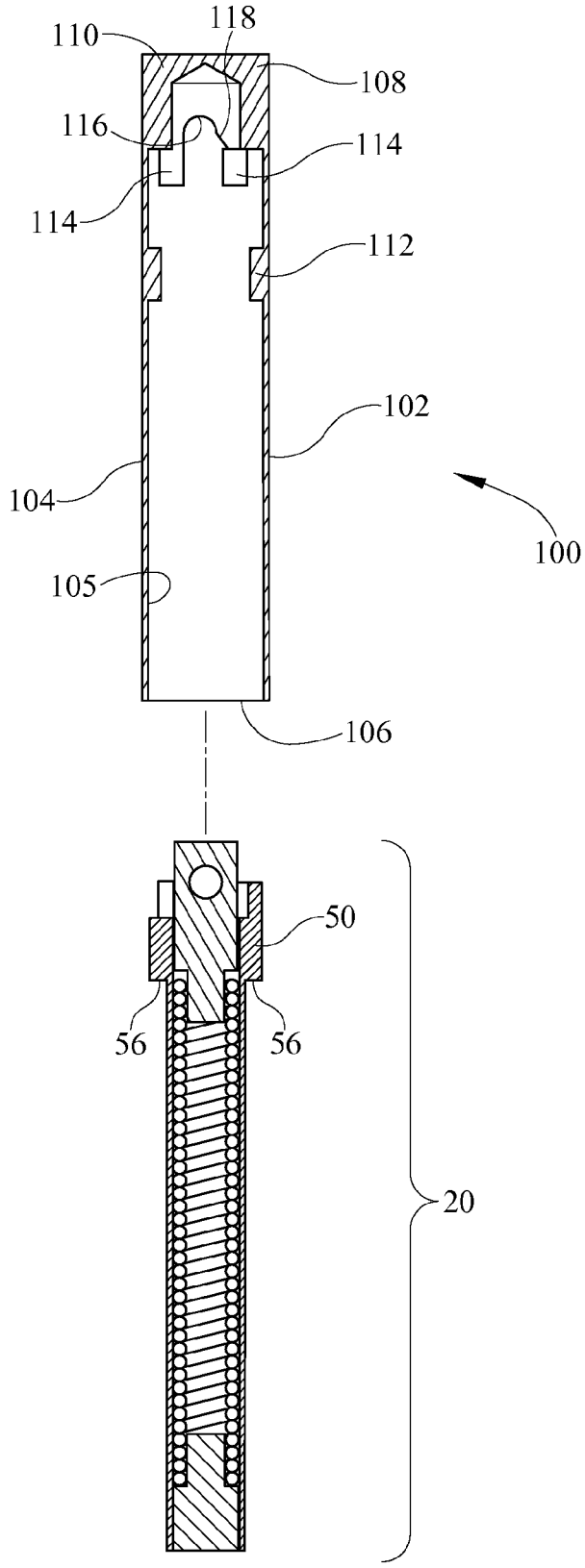
FIG. 5 is an exploded cross-sectional view of the intermediate tube assembly and stationary and pin assemblies in accordance with one embodiment of the present invention.
Figure 6:
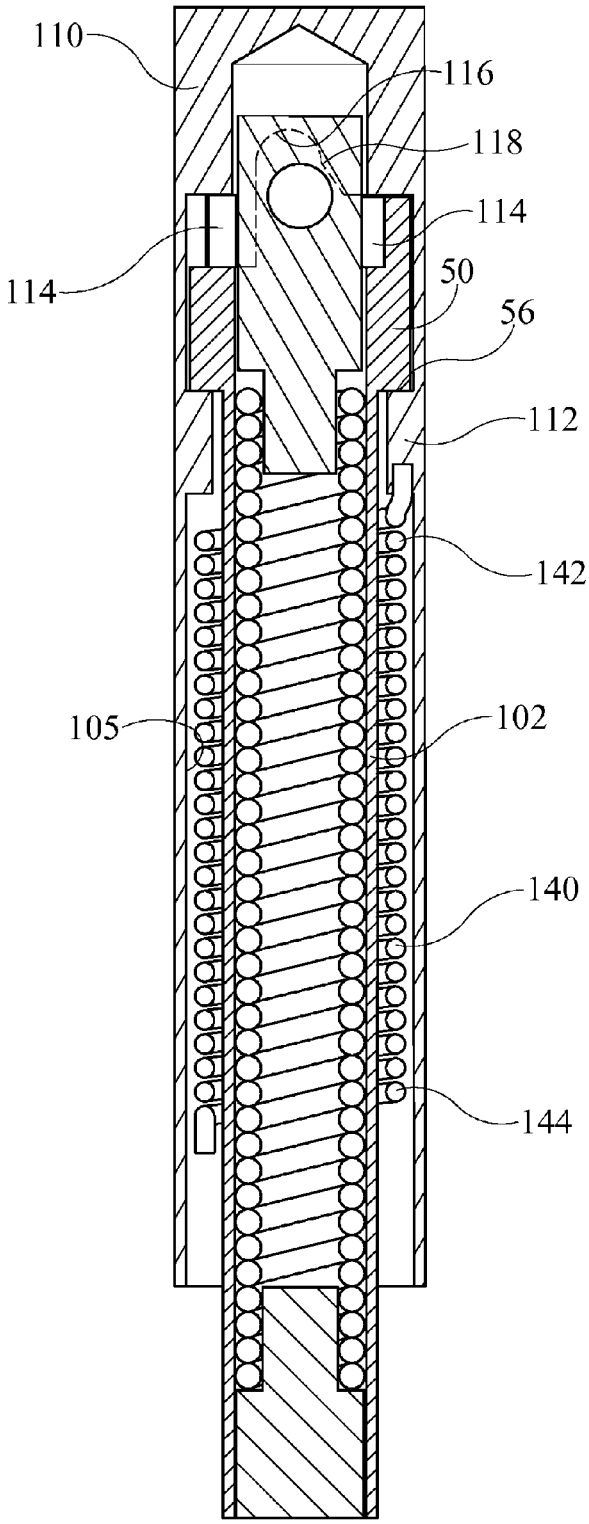
FIG. 6 is an assembled cross-sectional view of the intermediate tube assembly and stationary and pin assemblies in accordance with one embodiment of the present invention.

Referring now to FIGS. 2, 5, and 6 an intermediate tube assembly 100 comprises a generally cylindrical hollow tube 102 having an exterior wall 104 and an interior wall 105, both terminating in an open lower end 106 such that intermediate assembly 100 can be positioned over stationary assembly 20. Intermediate tube 102 includes an engagement flange 112 that extends radially inwardly from interior wall 105 and is spaced thereon to engage lower edge 56 of clutch stationary portion 50, thereby securing intermediate assembly 100 to stationary assembly 20.

Intermediate tube 102 further comprises an upper end 108 on which is formed a clutch rotating assembly 110, integral with upper end 108 of tube 108. Clutch rotating portion 110, in an analogous fashion to clutch stationary portion 50, includes a pair of spaced pin stops 114, and a pin recess 116 in which pin 72 may reside when intermediate assembly 100 and stationary assembly 20 are properly oriented. Pin recess 116 may also include a ramped portion 118 that extends between one pin stop 114 and pin recess 116, along which pin 72 travels as it rotates along with clutch rotating portion 110. It should be noted that intermediate tube 102 and clutch rotating portion 110 are integral to (or at least secured to) each other such that they rotate together, as will be discussed in greater detail below.

FIG. 6 depicts intermediate tube assembly 100 and stationary assembly 20 nested together, and further depicts a second torsional spring 140 that is secured at an upper end 142 thereof to intermediate tube assembly 102. Second torsional spring 140 is positioned between the interior wall 105 of intermediate tube 102 and stationary assembly 20.

Figure 7:
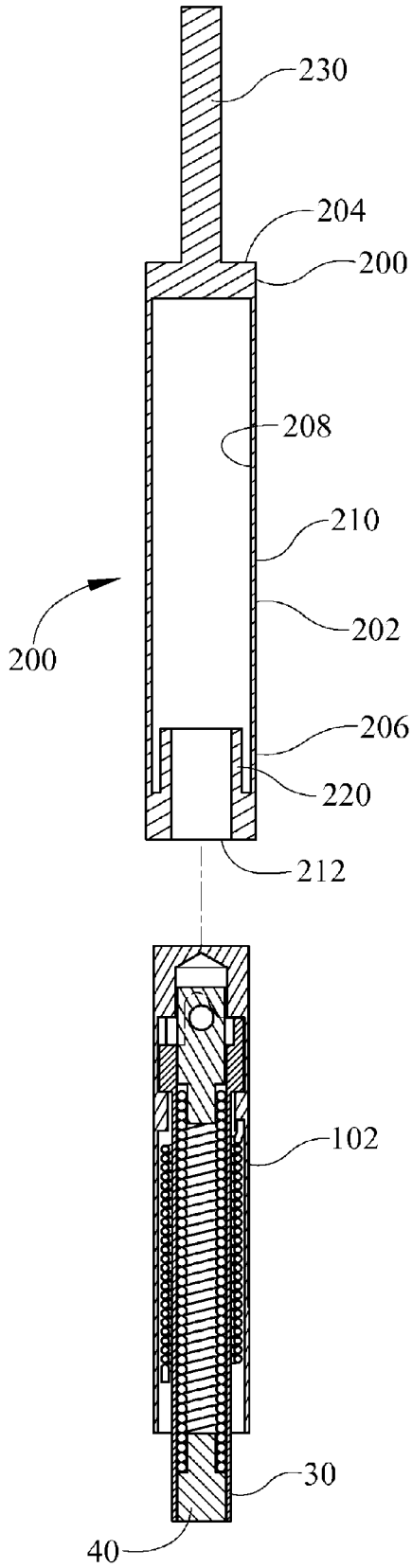
FIG. 7 is an exploded cross-sectional view of the exterior tube assembly and the assembled intermediate tube, stationary and pin assemblies in accordance with one embodiment of the present invention.
Figure 8A:
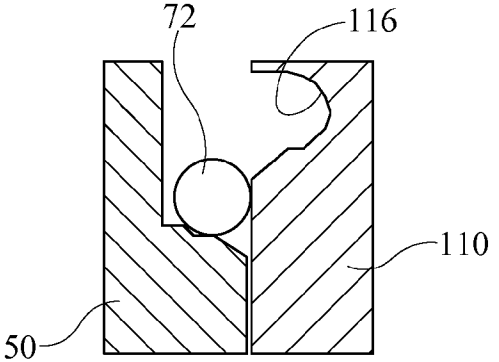
FIGS. 8A through 8E are simplified a cross-sectional views of the torsional pin, stationary clutch, and rotating clutch depicting the sequence of the torsional pin being passed from stationary clutch to rotating clutch in accordance with one embodiment of the present invention.
Figure 8B:
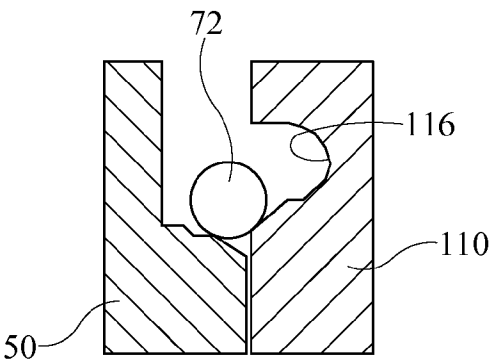
Figure 8C:
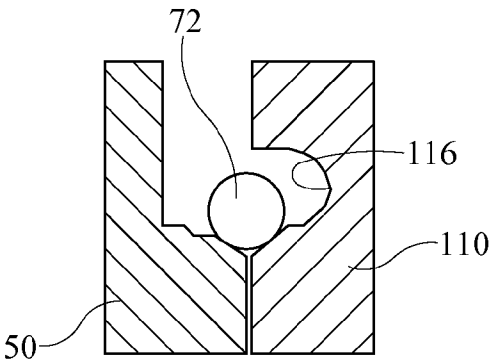
Figure 8D:
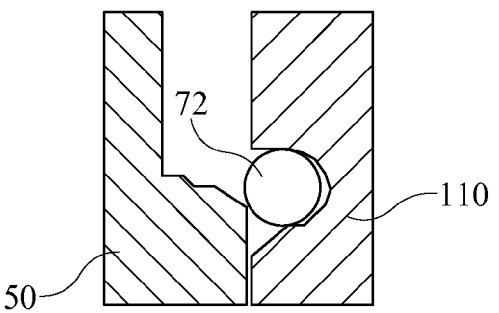
Figure 8E:
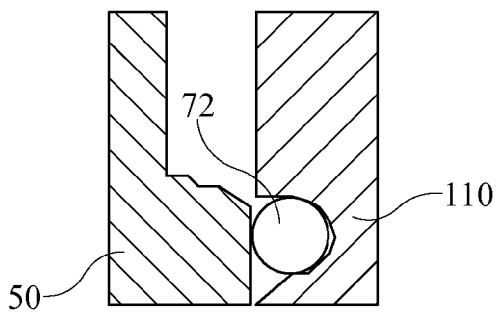
Figure 8F:
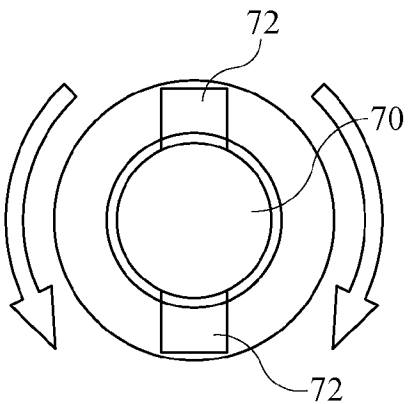
FIG. 8F is a simplified cross-section view of the torsional pin and stationary clutch in accordance with one embodiment of the invention.
Figure 9:
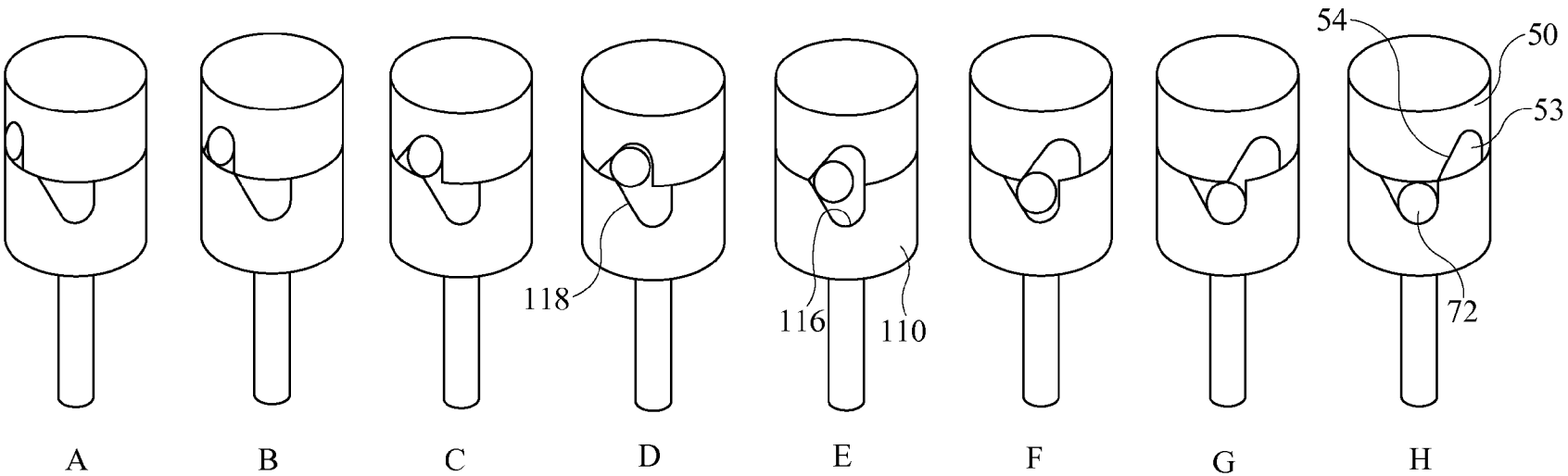
FIGS. 9A-9H are sequential perspective views of the operation of the stationary and rotating clutch portions and the torsional pin being passed there between in accordance with one embodiment of the present invention.

Referring now to FIGS. 2 and 7, self-closing hinge 10 further comprises an exterior tube assembly 200 including a cylindrical exterior tube 202 that has both upper 204 and lower 206 ends. Exterior tube 202 includes an interior wall 208 and an exterior wall 210, as well as an opening 212 at the lower end 206 thereof, through which the bottom 40 of inner tube 30 extends when the components are assembled. Additionally exterior tube 202 includes an interior cylindrical flange 220 at the lower end 206 thereof, said flange 220 spaced radially inwardly of interior tube wall 208. As best seen in FIG. 2 cylindrical flange 220 engages intermediate tube 102 at a lower portion thereof. Second torsional spring 140 is secured to cylindrical flange 220 at a lower end 144 thereof. Since torsional spring 140 is secured at its upper end 142 to intermediate tube 102 engagement flange 112, spring 140 provides a rotational bias between intermediate tube assembly 100 and exterior tube assembly 200.

Exterior tube assembly 200 finally includes a shaft 230 that is generally concentric with and secured to exterior tube 202. Shaft 230 may be advantageously secured to a hinged member, such as a toilet seat or cabinet door or the like.

In a yet further embodiment of the invention as best seen in FIG. 2 a viscous fluid 260 is disposed between the exterior wall 104 of intermediate tube 102 and the interior wall 208 of exterior tube 202. Viscous fluid 260 may comprise any number of commercially available high viscosity fluids. In an exemplary embodiment, not in any way limiting of the present invention, viscous fluid 260 may comprise a pure silicon fluid having a viscosity of approximately 20,000,000 centistokes (cSt). It should be noted that a range of fluid viscosities may be employed in various embodiments of the present invention depending upon the dampening effect required for a given hinge application without departing from the scope of the present invention.

FIGS. 8 and 8A-E depict the rotation of the clutch assembly as torsion pin 72 is passed or "handed-off" from stationary clutch portion 50 to rotating clutch portion 100. Furthermore, FIGS. 9A-H depict isometric views of stationary clutch portion 50 and rotating clutch portion 110 as they move relative to each other as self closing hinge 10 operates. Note that stationary clutch portion 50 does not move throughout the sequence depicted in the drawings, but rotating clutch portion 110 does.

As an example of operation of self closing hinge 10, shaft 230 is secured to a rotating member (not shown) and the stationary assembly is secured to a non-rotating member (not shown) such that when the rotating member is in a first or closed position, torsion pin 72 is engaged by rotating clutch portion 110 pin recess 116. Once the rotating member is lifted tube 202 must rotate against the force of the viscous fluid between tube 202 and intermediate tube 102. Since this force is relatively high, the intermediate tube 102 initially rotates with outer tube 202. Once the rotation of intermediate tube 102 has gone approximately forty degrees (depending upon the location of pin recess 116) the rotating clutch portion 110 passes off torsion pin 72 to stationary clutch portion 50 where pin 72 nestles into pin space 53.

As the rotating member continues to rotate until stopped, the spring connecting intermediate tube assembly 100 to exterior tube assembly 200 forces intermediate tube 102 to twist until torsion pin 72 once again lines up with pin recess 116 in rotating clutch portion 110, thereby transferring all the force from pin 72 to intermediate tube assembly 100. Once again, since the viscous fluid resists sudden relative motion between intermediate tube 102 and exterior tube 202, the twisting force applied to intermediate tube 102 causes the exterior tube 202 to twist with it, thereby forcing the rotating member to rotate to a closed position. Once this rotation continues for about 40 degrees or so, the torsion pin 72 contacts pin stops 52, thereby stopping rotation of intermediate tube assembly. As gravity takes over (in the case of, for example, a toilet seat as a rotating member) the rotating member will continue to close, forcing the exterior tube 202 to spin while intermediate tube 102 remains stationary against pin stops 52, thereby "resetting" the torque in the spring between the two tubes. Once the rotating member comes to rest, the self-closing hinge 10 is then completely reset for further use.

While the present invention has been shown and described herein in what are considered to be the preferred embodiments thereof, illustrating the results and advantages over the prior art obtained through the present invention, the invention is not limited to those specific embodiments. Thus, the forms of the invention shown and described herein are to be taken as illustrative only and other embodiments may be selected without departing from the scope of the present invention, as set forth in the claims appended hereto.

I claim:

1. A self-closing hinge comprising:

a stationary assembly comprising a hollow cylindrical tube having a first end and a second end having a clutch stationary assembly secured thereto;

a first torsional spring positioned within said tube and secured at the first end thereof, and having a pin secured at a second end of said first torsional spring whereby said spring biases said pin in a first direction and whereby said pin rotates to engage said clutch stationary assembly at a at least one point;

a rotating intermediate tube assembly comprising a generally hollow cylinder having a first end positioned over said stationary assembly, and a second end having a clutch rotating assembly, whereby said pin of said first torsional spring engages said clutch rotating assembly at a point;

an exterior tube assembly comprising a generally hollow cylinder having a first open end positioned over said intermediate tube assembly and a second closed end, and a second torsional spring positioned between and secured to said intermediate tube assembly and said exterior tube assembly;

said clutch stationary assembly having a pair of spaced stops against which the pin of said first torsional spring abuts when completely rotated in a first direction to inhibit further rotation;

said clutch rotating assembly having a recessed portion in which said pin is permitted to rotate, and a pin stop that rotates with said clutch rotating assembly until it abuts a one of said stationary assembly stops, thereby inhibiting further rotation of said rotating assembly;

said exterior tube assembly having a cylindrical flange disposed on said first end, for engaging the first end of said intermediate tube assembly, and permitting rotation of said exterior tube assembly with respect to said intermediate tube assembly; and a viscous fluid disposed between said exterior tube and said intermediate tube to slow rotation of said tubes relative to each other.

2. A self-closing hinge as claimed in claim 1 comprising: a ramped portion on said clutch stationary assembly for engaging said rotating pin and forcing said pin to engage said clutch rotating assembly.

3. A self-closing hinge as claimed in claim 1 wherein said viscous fluid comprises a silicon fluid.

4. A self-closing hinge as claimed in claim 1 wherein said viscous fluid has a kinematic viscosity in the range of 10-20 million cSt.

5. A self-closing hinge as claimed in claim 1 comprising a shaft extending from said exterior tube assembly for engaging a rotating member.

* * * * *